US005432405A

United States Patent [19]

Ochiai et al.

[11] Patent Number: 5,432,405

[45] Date of Patent: Jul. 11, 1995

[54] MAGNETRON DEVICE HAVING AN ANTENNA SHAPED ELECTRODE

[75] Inventors: Hiroshi Ochiai; Shinichi Suzuki, both of Uysunomiya; Masanori Yoshihara, Imaichi; Shinobu Yoshikawa, Shioya; Kazuo Suzuki, Shimotsuga, all of Japan

[73] Assignee: Matsushita Electronics Corporation, Kadoma, Japan

[21] Appl. No.: 13,350

[22] Filed: Feb. 3, 1993

[30] Foreign Application Priority Data

Feb. 4, 1992 [JP] Japan ..... 4-018646

[51] Int. Cl.[6] ..... H01J 23/15

[52] U.S. Cl. ..... 315/39.51

[58] Field of Search ..... 315/39.51, 39.63, 39.67

[56] References Cited

U.S. PATENT DOCUMENTS

| | | | |
|---|---|---|---|
| 4,131,824 | 12/1978 | Nakai et al. | 315/39.51 |
| 4,169,987 | 10/1979 | Oguro et al. | 315/39.71 X |
| 5,021,713 | 6/1991 | Uesawa et al. | 315/39.51 |

FOREIGN PATENT DOCUMENTS

| | | | |
|---|---|---|---|
| 270005 | 6/1988 | European Pat. Off. . | |
| 339374 | 11/1989 | European Pat. Off. . | |
| 66835 | 5/1980 | Japan | 315/39.51 |
| 157031 | 6/1989 | Japan | 315/39.51 |

*Primary Examiner*—Benny T. Lee

*Attorney, Agent, or Firm*—Cushman, Darby & Cushman

[57] ABSTRACT

A pair of core-insertion-type choke coil constituting the filter circuit are connected to cathode terminals, of a magnetron, and antenna-like electrode (15 or 16) are provided extending from respective cathode terminals 10, without having any terminating connection; thereby undesirable outside leakage of the microwave is considerably decreased.

5 Claims, 9 Drawing Sheets

MAGNETRON DEVICE HAVING AN ANTENNA SHAPED ELECTRODE

FIELD OF THE INVENTION AND RELATED ART STATEMENT

1. Field of the Invention

The present invention relates to a magnetron device used in a microwave heating apparatus such as a microwave oven.

2. Related Art Statement

In general, a magnetron device to be used in a microwave heating apparatus which has been on the market and partly disclosed in the U.S. Pat. No. 5,021,713 has a configuration such as shown in FIGS. 10 and 11. It works at a fundamental wave of 2,450 MHz. A magnetron 1 has an anode cylinder 3, a coil-shaped cathode 2 disposed coaxially with and in the anode cylinder 3, a pair of frust-conical magnetic pole pieces 4 and 5 disposed above and under the cathode 2, respectively, a microwave radiation antenna 6 at the top and a stem insulator 7. A frame-shaped magnetic yoke 8 is for constituting an external magnetic circuit together with a permanent magnet which is located outside the figure. The stem insulator 7 is contained in a shielding metal case 9 which is attached to a bottom plate part of the magnetic yoke 8. A pair of cathode terminals 10 are disposed on the lower end-face of the stem insulator 7 (in a manner that they are disposed symmetrically with regard to the plane of the drawing of FIG. 10); and respective ends of a pair of core-insertion-type choke coils 11 are connected to the pair of cathode terminals. Respective other-ends of a pair of core-insertion-type choke coils 11 are connected to a pair of feed-through electrodes 13 of a feed-through-type capacitor 12 attached to the side wall of the shielding metal case 9, respectively. The core-insertion-type choke coil 11 has an inductance-increasing ferrite core 14, which also converts a part of the electromagnetic energy induced by a microwave current in the core-insertion-type choke coil 11 thereby to attenuate undesirable radiation of the microwave energy to outside space of the microwave oven.

In the conventional magnetron device constituted in a manner as stated above, undesirable external leakage of the microwave radiation to the outside of the apparatus to the cathode terminal 10 from a resonant cavity of the magnetron 1 is stopped by an LC filter circuit comprising the core-insertion-type choke coil 11 and the feed-through-type capacitor 12 and the shielding metal case 9. And, since the ferrite core 14 not only functions as an inductor but also functions as a radio frequency power absorber, external leakage of unnecessary radiation having 30–300 MHz frequency range components to the outside of the apparatus can be stopped efficiently.

In a magnetron device described in U.S. Pat. No. 4,131,824, as is shown in FIG. 11, such a configuration is taken that an air-core-type choke coil 11' is inserted between the cathode terminal 10 and the core-insertion-type choke coil 11. In this case, the unnecessary radiation including the fundamental wave component appearing on the cathode terminal side reaches the core-insertion-type choke coil 11 after attenuation by the air-core-type choke coil 11', and therefore a possible burn-out of the ferrite core 14 and the choke coil 11' can be prevented.

However, in order to prevent the generation of noise in the 30–300 MHz range through suppression of undesirable leakage of the unnecessary radiation to the outside of the apparatus, and also to thoroughly prevent the burn-out of the ferrite core 14 and the choke coil 11, it is necessary to increase the pitch of the winding of the air-core-type choke coil 11' while keeping the turn number of the core-insertion-type choke coil 11. Therefore, a series-connected body of the choke coils 11 and 11' becomes large and long, hence in order to store it inside the shielding metal case 9, it is necessary to keep the internal volume of the shielding metal case 9 sufficiently large. There has also been a problem in designing the size of the shielding metal case 9 to be small. There has also been the problem that a stable holding of the series-connected body inside the shielding metal case 9 was difficult because of the size and length of the body.

OBJECT AND SUMMARY OF THE INVENTION

The magnetron device in accordance with the present invention comprises a magnetron having cathode terminals disposed by projection on an external end-face of a stem insulator thereof, a core-insertion-type choke coil constituting a filter circuit by being connected to the above-mentioned cathode terminals, and antenna-like electrodes extending from the above-mentioned cathode terminals without having any terminating connection. The antenna-like electrode can be formed as an extended part of the core-insertion-type choke coil, and it can also be formed with a conductive film disposed on the stem insulator.

By constituting a magnetron device as described above, a part of the unnecessary radiation including the fundamental wave component appearing on the cathode terminal side from the resonant cavity of the magnetron is decreased because of the reflecting action of the antenna-like electrodes. As a result, a burn-out due to an excessive dissipation in the core-insertion-type choke coil can be prevented. Since the cathode electrodes are connected to a series-connected point between the core-insertion-type choke coil and the antenna-like electrode, a stable holding thereof becomes possible. Furthermore, since the space in the shielding metal case can be utilized efficiently by dispensing with the space-taking air-core-type choke coil, a reduction of the size of the shielding metal case as well as reduction of the production-cost become possible. Also, since the air-core-type choke coil is not connected in series to the core-insertion-type choke coil, a drop in the cathode voltage can be prevented, particularly if using an inverter power supply. Still furthermore, it is found that noise in the lower side band (LSB) and the upper side band (USB) are drastically decreased, thereby eliminating undesirable noise radiation to the outside space which especially causes problems for portable telephone signals.

As has been explained above, in accordance with the present invention, not only the burn-out of the core-insertion-type choke coil can be prevented, but also a stable holding of the core-insertion-type choke coil becomes possible, and moreover, a size reduction of the shielding metal case as well as a reduction of the production-cost becomes possible. Also, at the time of using an inverter power supply, a drop in the cathode voltage can be prevented. Furthermore, as a result of experiments, it became clear that the noise at both sidebands having its center at the fundamental wave band thereof as well as the noise at the side-bands of the harmonics could be reduced.

Figure 1:
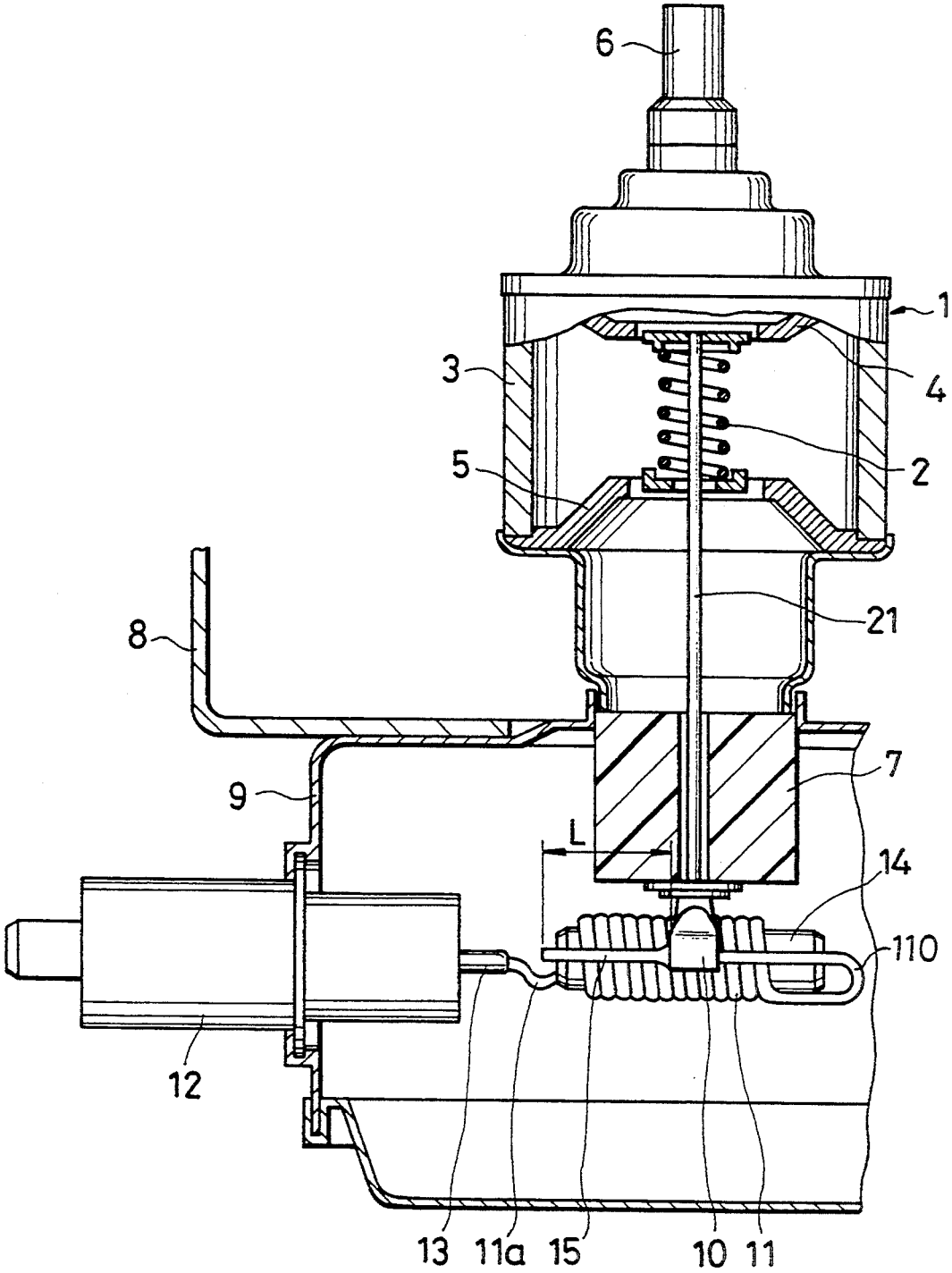
FIG. 1 is a partly sectional side view of a magnetron device using the present invention.

It will be recognized that some or all of the Figures are schematic representations for purposes of illustration and do not necessarily depict the actual relative sizes or locations of the elements shown.

DESCRIPTION OF THE PREFERRED EMBODIMENT

Next, the present invention is explained with reference to the embodiments shown by drawings FIGS. 1 through FIG. 7. Similar elements in different figures have the same reference numerals.

Figure 2:
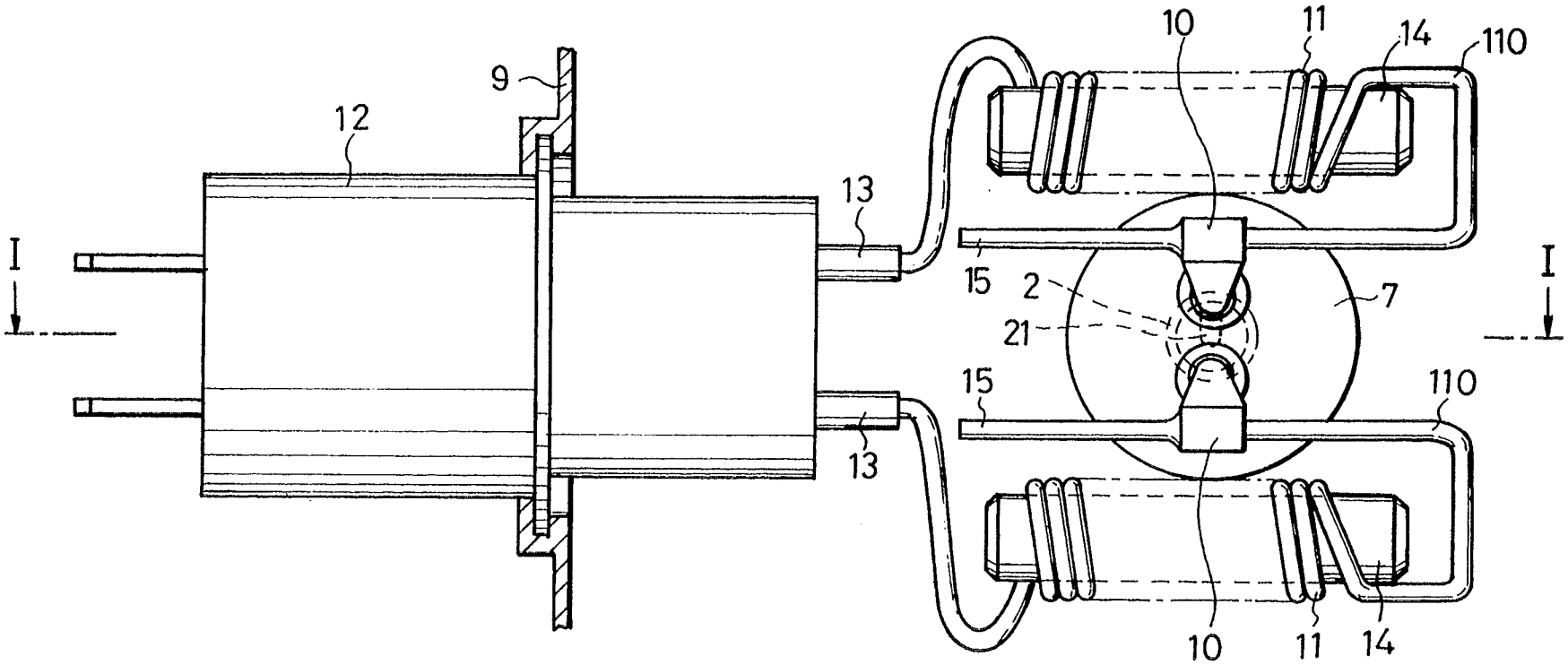
FIG. 2 is a bottom view of the principal part of the magnetron device of FIG. 1.

As shown in FIGS. 1 and 2, a magnetron 1 has an anode cylinder 3, a coil-shaped cathode 2 disposed coaxially with and in the anode cylinder, a pair of frust-conical magnetic pole pieces 4 and 5 disposed above and under the cathode 2, respectively, a microwave radiation antenna 6 at the top and a stem insulator 7. A frame-shaped magnetic yoke 8 is for constituting an external magnetic circuit together with a permanent magnet which is located outside the figure. The stem insulator 7 is contained in a shielding metal case 9 which is attached to a bottom plate part of the magnetic yoke 8. As seen in FIG. 2, a pair of cathode terminals 10 are disposed on the lower end-face of the stem insulator 7 in a manner that they are disposed symmetrically with the plane of the drawing of FIG. 1. Respective ends of a pair of core-insertion-type choke coils 11 are connected to the pair of cathode terminals 10. Respective other-ends of the pair of core-insertion-type choke coils 11 are connected directly (i.e., without any device therebetween) to a pair of feed-through electrodes 13 of a feed-through-type capacitor 12 attached to the side wall of the shielding metal case 9, respectively. A pair of antenna-like electrodes 15 are provided attached to the respective cathode terminals 10 in a manner or configuration that, for example, they linearly extend from the respective connecting leads 110 between the core-insertion-type choke coils 11 the cathode terminals 10, or that they extend from the respective connecting leads 110 but are folded at the part of the cathode terminals 10. The other end of each antenna-like electrode 15 does not have any terminating connection. Each core-insertion-type choke coil 11 has an inductance-increasing ferrite core 14, which also converts a part of the electromagnetic energy induced by a microwave current in the core-insertion-type choke coil 11 thereby to attenuate undesirable radiation of the microwave energy to outside space of the microwave oven.

Figure 8A:
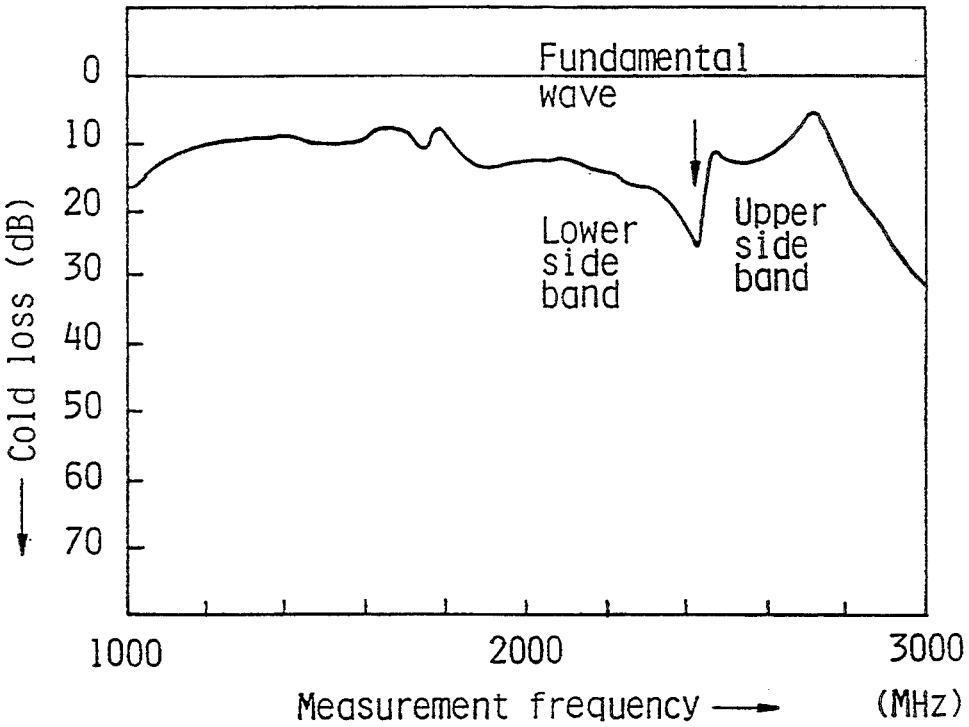
FIG. 8(a) (PRIOR ART)
FIGS. 8(*a*) and 8(*b*) show respectively comparison graphs for cold loss of the prior art and the present invention measured by connecting a measuring device from the connecting point of ends of core-insertion-type choke coil and feed-through-type electrodes of feed-through type capacitors to a microwave radiation antenna.
Figure 8B:
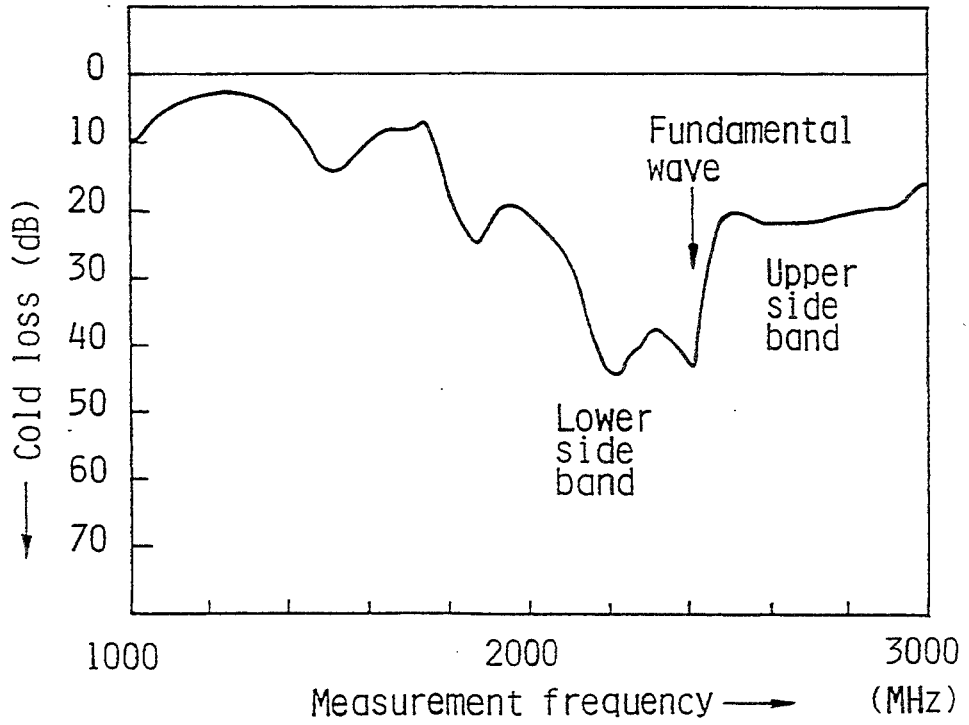
Figure 10:
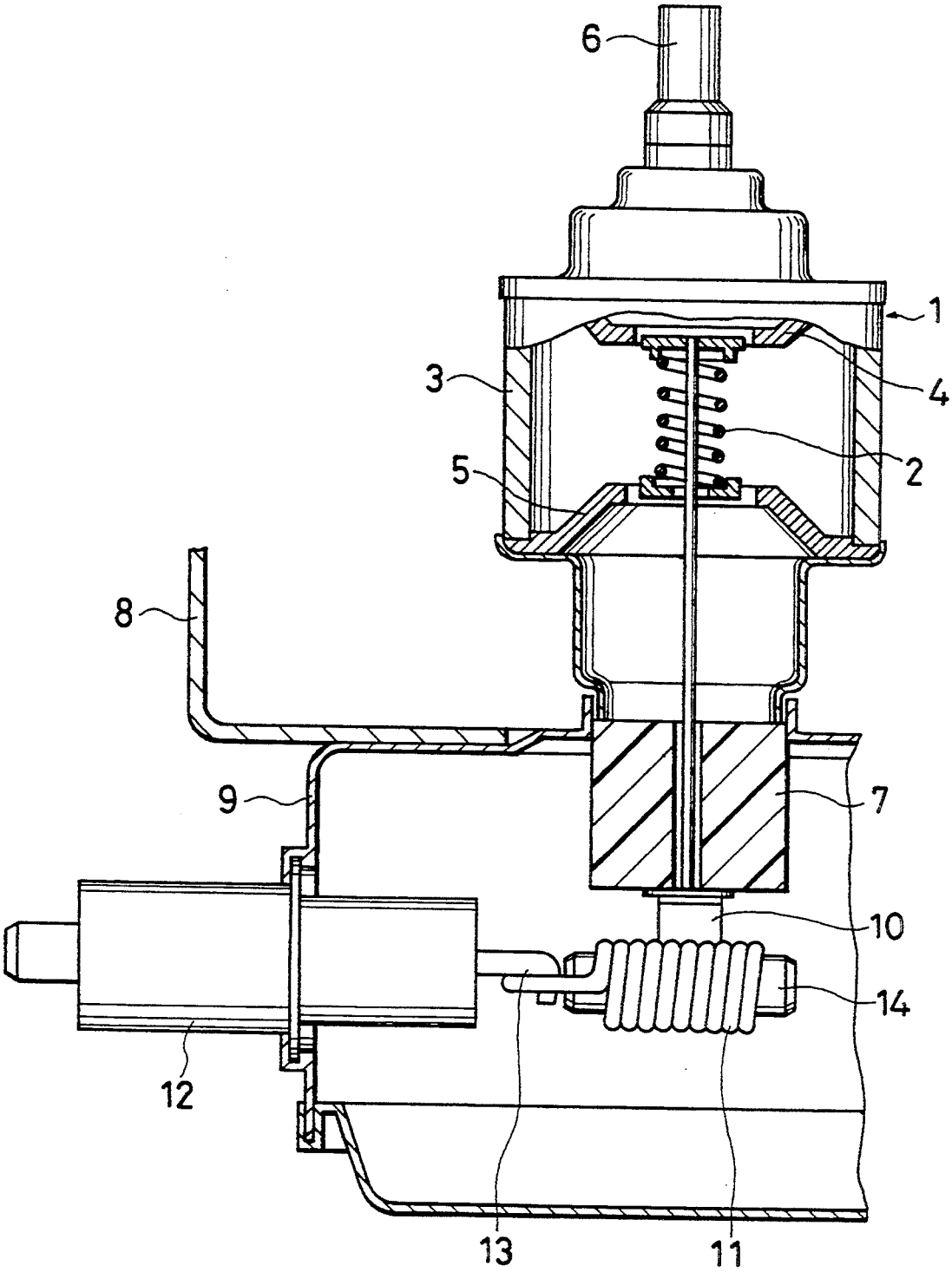
FIG.10(Prior Art)
FIG. 10 is a partly sectional side view of a magnetron device of the prior art.

In summary, a first feature or difference of the configuration of the embodiment shown in FIG. 1 and FIG. 2 from that of the conventional example shown in FIG. 8(*a*) is that: respective other-ends 11*a* (see FIG. 1) of two core-insertion-type choke coils 11, whose respective one-ends connected respectively to a pair of cathode terminals 10 of a magnetron 1, are connected absolutely directly to a respective pair of feed-through-type electrodes 13 of feed-through-type capacitors 12. No air-core-type choke coils 11' like that shown in FIG. 10 are disposed therebetween. A second feature is that the antenna-like electrodes 15 are extended from the respective cathode terminals 10 without having any terminating connection.

Figure 3:
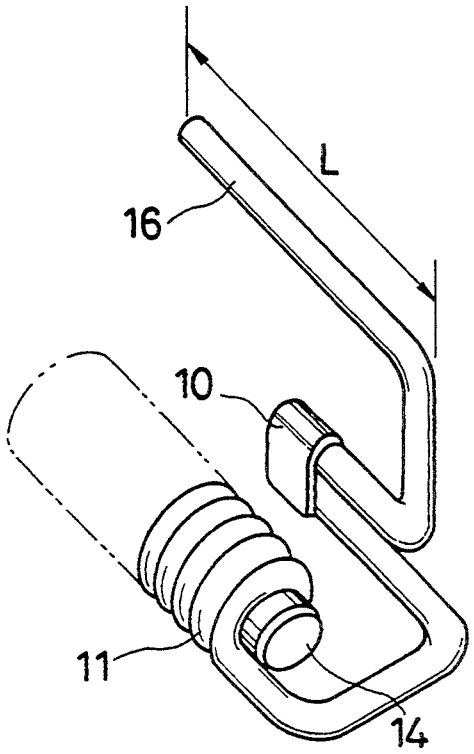
FIG. 3 is a perspective view of the principal part of another embodiment of the present invention.

Apart from the above-mentioned example where antenna-like electrodes 15 are linearly extended parts of the core-insertion-type choke coils 11, a further embodiment can be configured such as shown in FIG. 3 where a separate bar-shaped conducting wire is used as the antenna-like electrode 16, and it is secured to the cathode terminal 10. In FIG. 3, L designates the length of extension of the antenna-like electrode 16.

Figure 4:
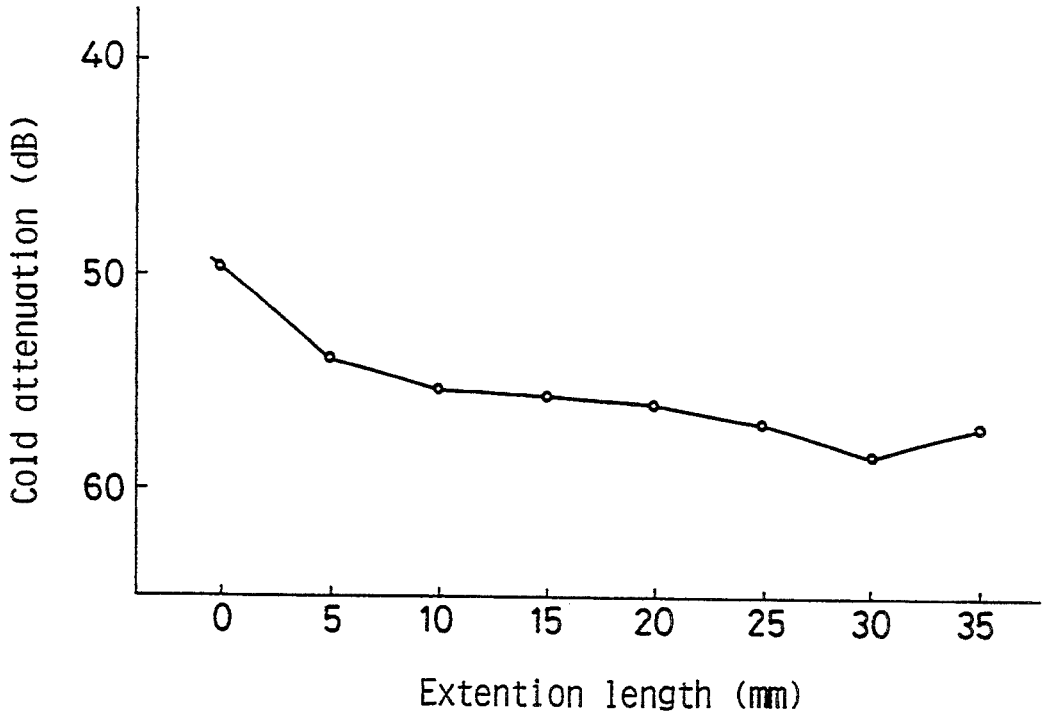
FIG. 4 is a cold attenuation characteristic curve of the magnetron device whereon the present invention is applied.
Figure 5:
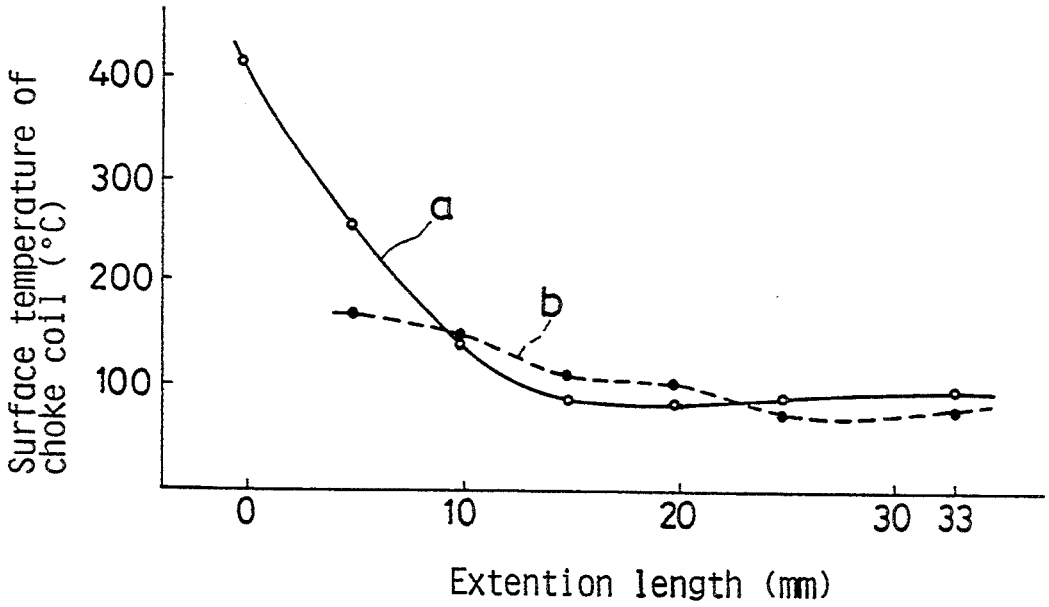
FIG. 5 is a graph of surface temperature characteristic curves of a core-insertion-type choke coil of the same magnetron device.
Figure 6:
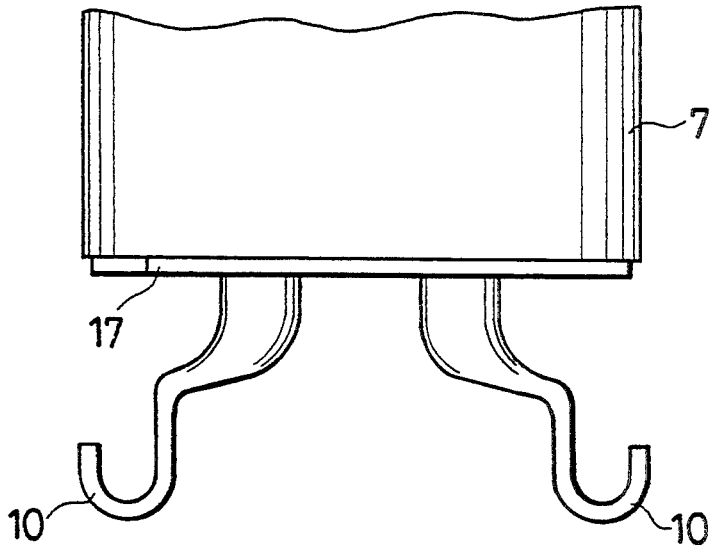
FIG. 6 is a side view of the principal part of another embodiment of the present invention.
Figure 7:
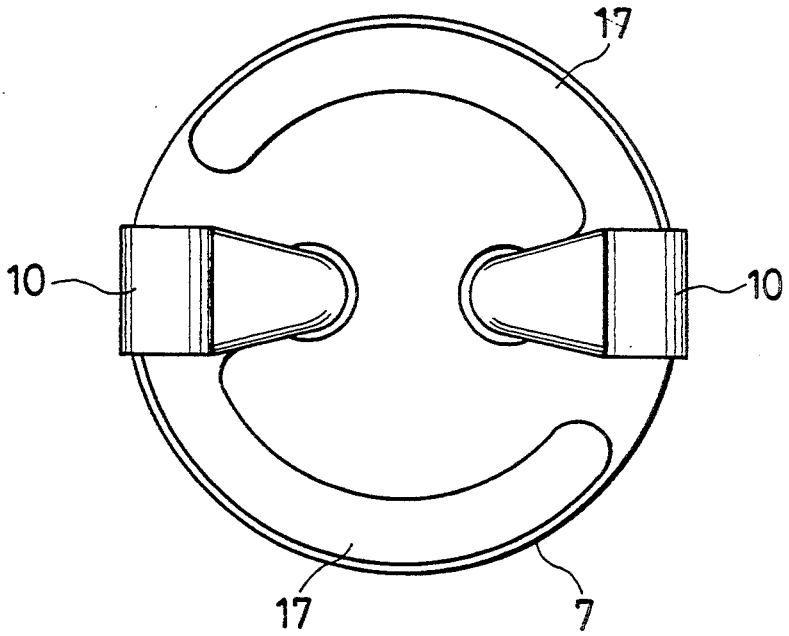
FIG. 7 is a bottom view of principal part of the embodiment of FIG. 6.
Figure 11:
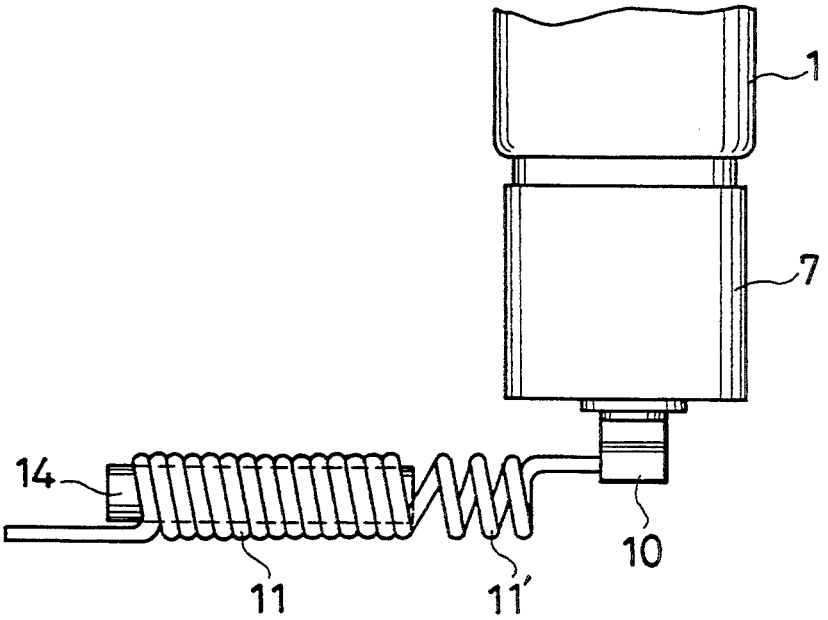
FIG.11(Prior Art)
FIG. 11 is a side view of a part of a magnetron device of the prior art.

As is shown in FIG. 4, it was found that, when the extension length L (shown in FIGS. 1 and 3) is 15 mm or more, the amount of cold attenuation (i.e. attenuation at a cold condition) reached as large as 55 dB. Hereupon, this value can correspond to an amount of the cold attenuation in the conventional configuration of FIG. 11, wherein the air-core-type choke coil was used. Also, the surface temperature at one-end (connecting-end to the cathode terminal side) and the surface temperature at the other-end (connecting-end to the capacitor side) respectively of the core-insertion-type choke coil 11 could be kept as low as 100° C., as is shown respectively by curves a and b in FIG. 5.

Apart from the above-mentioned embodiment, the antenna-like electrode can be bent shaped or coil shaped. In the embodiments shown in FIG. 6 and FIG. 7, two semi-circular arc shaped conductive films 17 are disposed on the bottom surface of the ceramic stem insulator 7 as antenna-like electrodes; and their respective ends are connected electrically to the cathode terminals 10. In this case, it is possible to obtain the same amount of cold attenuation as in the embodiment described previously, and besides that, the shielding metal case can be formed in a still smaller size.

FIGS. 8(*a*), 8(*b*), 9(*a*) and 9(*b*) comparingly show cold losses and noise levels at oscillation, respectively, for the prior art (shown by FIGS. 8(*a*) and 9(*a*)) and the present invention (shown by FIGS. 8(*b*) and 9(*b*)). The cold losses of the prior art and the present invention are measured by a known measuring device which is connected from the connecting point of the end 11*a* of the core-insertion-type choke coil 11 and feed-through-type electrodes 13 of the feed-through type capacitors 12 to a microwave radiation antenna 6.

As shown by FIGS. 8(*a*) and 8(*b*), the cold loss (which is the loss at a non-oscillation state of the magnetron) is much improved from the prior art of FIG. 8(*a*) to the present invention of FIG. 8(*b*). In other words undesirable radiation from the microwave is significantly decreased in the present invention.

Figure 9A:
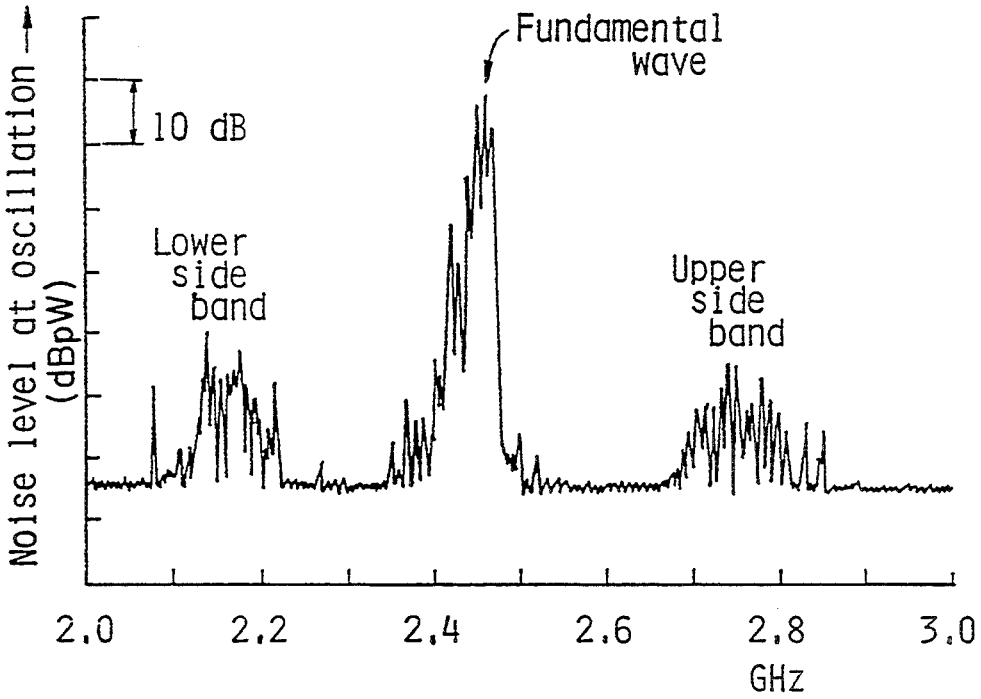
FIG. 9(a) (PRIOR ART)
FIGS. 9(*a*) and 9(*b*) shows respectively comparison graphs for noise levels at oscillation of the prior art and the present invention.
Figure 9B:
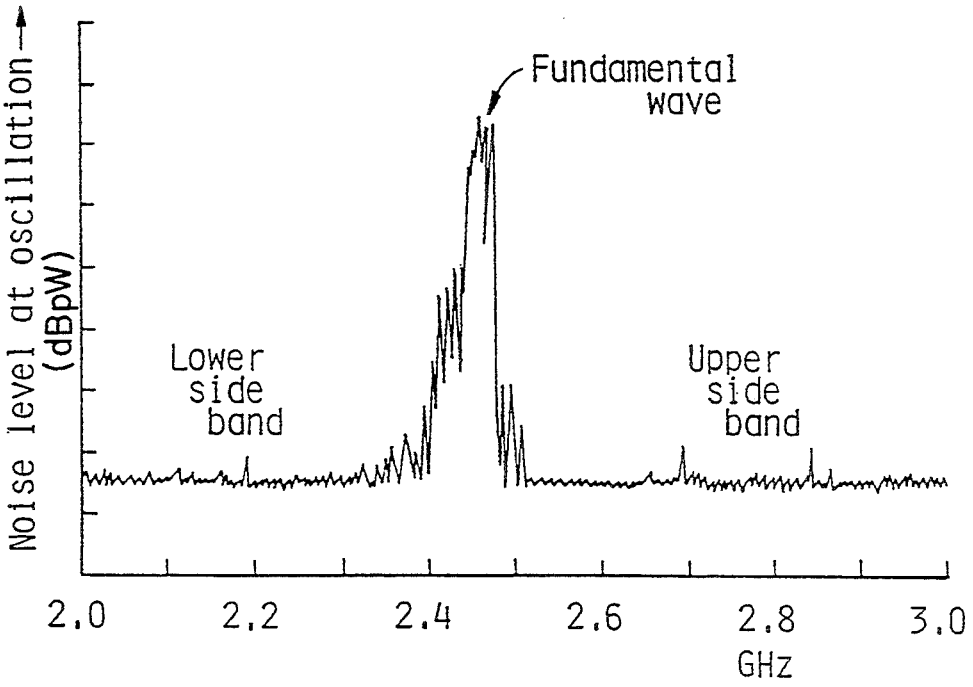

Thus, as shown by FIGS. 9(*a*) and 9(*b*), the noise level at oscillation is significantly decreased in general, and in particular concerning the lower side band and the upper side band, which overlap with the frequency bands of portable telephones (movable telephones). Therefore, the magnetron of the present invention is reduced in radiation of noise to the outside space.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A magnetron device comprising:

an anode;

a cathode;

a resonant cavity between said anode and said cathode;

a stem insulator having a cathode terminal connected to said cathode and projecting from an external end-face of said stem insulator;

a core-insertion-type choke coil constituting a filter connected to said cathode terminal; and an antenna-shaped electrode extending from said cathode terminal and having an electrically unterminated end, said antenna-shaped electrode reflecting a radiation from said resonant cavity of said magnetron device via said cathode terminal.

2. A magnetron device in accordance with claim 1, wherein said antenna-shaped electrode is defined by an end of said core-insertion-type choke coil.

3. A magnetron device in accordance with claim 1, wherein said antenna-shaped electrode is a folded end of said core-insertion-type choke coil.

4. A magnetron device in accordance with claim 1, wherein said antenna-shaped electrode is a separate bar-shaped conducting wire crimped to said cathode terminal.

5. A magnetron device in accordance with claim 1, wherein said antenna-shaped electrode is a conductive film having a predetermined pattern disposed on said stem insulator.

* * * * *